US009778668B2

(12) United States Patent
Edwards et al.

(10) Patent No.: US 9,778,668 B2
(45) Date of Patent: Oct. 3, 2017

(54) SENSED SWITCH CURRENT CONTROL

(71) Applicants: William E. Edwards, Ann Arbor, MI (US); Anthony F. Andresen, Chandler, AZ (US)

(72) Inventors: William E. Edwards, Ann Arbor, MI (US); Anthony F. Andresen, Chandler, AZ (US)

(73) Assignee: NXP USA, INC., Austin, TX (US)

( * ) Notice: Subject to any disclaimer, the term of this patent is extended or adjusted under 35 U.S.C. 154(b) by 427 days.

(21) Appl. No.: 14/502,002

(22) Filed: Sep. 30, 2014

(65) Prior Publication Data

US 2016/0091908 A1 Mar. 31, 2016

(51) Int. Cl.
*G05F 1/56* (2006.01)
*H01H 1/60* (2006.01)

(52) U.S. Cl.
CPC ..... *G05F 1/56* (2013.01)

(58) Field of Classification Search
CPC ..... G05F 1/56
See application file for complete search history.

(56) References Cited

U.S. PATENT DOCUMENTS 4,977,478 A 12/1990 Powell
5,170,970 A 12/1992 Ballinger
5,237,211 A * 8/1993 Tanaka ..... H03K 17/567 327/403
5,523,633 A * 6/1996 Imaizumi ..... H01H 1/605 307/137
5,621,250 A * 4/1997 Kim ..... B60L 1/00 307/10.1
5,671,131 A 9/1997 Brown
5,714,852 A 2/1998 Enderich
6,600,242 B1 7/2003 Dennison
6,800,965 B1 10/2004 Turner et al.
7,497,785 B2 3/2009 Koncelik, Jr.
8,008,970 B1 8/2011 Homol et al.
8,120,502 B2 2/2012 Usukura et al.
8,143,749 B2 3/2012 Gagne
(Continued)

OTHER PUBLICATIONS

STIC Search Report; Jan. 10, 2017.*
(Continued)

*Primary Examiner* — Jared Fureman
*Assistant Examiner* — James Evans

(57) ABSTRACT

A circuit includes an evaluation node through which current flows from a voltage source node to a sensed switch when the sensed switch is closed. First and second control switches are disposed between the voltage source node and the evaluation node to switch between first and second current paths for the current. The current passes through the first control switch when flowing along the first current path. The second control switch is coupled to a control terminal of the first control switch to deactivate the first control switch and allow the current to flow through the second current path. Multiple passive circuit elements are configured to establish first and second current levels for the current. The passive circuit elements are disposed between the voltage source node and the evaluation node in a circuit arrangement in which no current path to ground is present when the sensed switch is open.

20 Claims, 4 Drawing Sheets

(56) References Cited

U.S. PATENT DOCUMENTS

| | | | | |
|---|---|---|---|---|
| 8,275,094 | B2 | 9/2012 | Li | |
| 8,570,147 | B2 | 10/2013 | Girard, III et al. | |
| 2005/0231876 | A1* | 10/2005 | Komatsu | H01H 1/605 361/103 |
| 2012/0078384 | A1* | 3/2012 | Kanayama | H01H 1/605 700/12 |

OTHER PUBLICATIONS

"24-Channel Automotive Switch Monitor", Maxim Integrated Products, 2009, pp. 1-14.
"Multiple Switch Detection Interface with Suppressed Wake-Up", Freescale Semiconductor, Inc., Mar. 2012, pp. 1-32.

* cited by examiner

SENSED SWITCH CURRENT CONTROL

FIELD OF INVENTION

The present embodiments relate to sensed switching.

BACKGROUND

Sensed switches are often used to control the operation of loads instead of powered switches. Powered switches are disposed serially with a load to directly control current delivered to the load. In contrast, sensed switches control the load current indirectly. The state of the switch, open or closed, is instead sensed by applying a low current signal and measuring the voltage. The opportunity to use a low current, voltage measurement leads to reduced wiring harness complexity, weight, and costs. In complex electrical systems with numerous switch-controlled loads, such as automobile vehicles, the cost savings may be considerable.

Determining the state of a sensed switch typically involves applying a test current and a voltage comparison. For example, a voltage level dictated by the state of the switch is compared with a threshold voltage. The voltage level is ideally not dependent on the voltage drop across the switch contacts. But unfortunately, the switch contacts oxidize over time due to humidity and contamination, increasing the resistance presented by the switch itself. The increased resistance and test current result in an increase in the sensed voltage, thereby increasing the risk of incorrect operation (i.e., detection). Switch contact oxidation may be especially challenging in connection with normally open switches, i.e., switches with contacts that close upon application of an external force.

The oxidation challenge presented by sensed switches is not applicable to the powered switch approach. In powered switches, the current levels are high enough to burn off any oxidation of the switch contacts. Because the current levels may be much lower with sensed switches, a wetting current is used to remove the oxidation from the switch contacts. The wetting current is typically a temporary current level of the current that flows through the switch contacts when the switch transitions from open to closed. The temporary current level is sufficient to remove the oxidation. A circuit used to detect the state of the switch may also be configured to control the application of the wetting current.

BRIEF DESCRIPTION OF THE DRAWINGS

The components and the figures are not necessarily to scale, emphasis instead being placed upon illustrating the principles of the various embodiments. Moreover, in the figures, like reference numerals designate corresponding parts throughout the different views.

DETAILED DESCRIPTION OF THE PRESENTLY PREFERRED EMBODIMENTS

Embodiments of methods, devices, and circuits for controlling current delivered to a sensed switch are described.

The current delivered to the sensed switch may include a wetting current. The wetting current may be delivered to a normally open sensed switch. The circuit may be configured to consume no current or power while the switch is open. The wetting current may be applied for a predetermined period of time after the sensed switch is closed. The level of current may then be switched (e.g., reduced) to a sustaining current or other (e.g., lower) level of current after the predetermined time period. The methods may be implemented by a device, unit, or other circuit coupled to a comparator directed to detecting and/or sensing the state of the switch.

Without quiescent power (or current) drain, the current control may be provided in a manner independent of system state. For example, the electrical system in which the sensed switch current control is provided may be in a shutdown or other low power state. A low power state may be useful in applications in which the power source is a battery, such as a vehicle battery. Thus, the current control is provided in a manner that does not drain the battery while waiting for closure of the sensed switch. In vehicular examples, the battery is not drained while the engine of the vehicle is not running.

The lack of quiescent current drain may be achieved as a result of an arrangement of passive (e.g., resistive) circuit elements that does not include a current path to ground while the sensed switch is open. The passive circuit elements are arranged in a circuit with a number of control switches configured to switch between current paths for the current. The switching provided by the circuit arrangement establishes multiple current levels to be provided to the sensed switch despite not being arranged in a current regulating loop or other circuit that uses quiescent current to control a switching network. One of the multiple current levels may be selected using the circuit arrangement, including an initial or default current level suitable for use as a wetting current for the sensed switch. The passive or resistive nature of the circuit arrangement may reduce susceptibility to damage and electrical overstress (EOS) induced by external transients, such as transients arising from electrostatic discharge (ESD) events.

Closure of the sensed switch provides power to the current control circuit. For instance, closure of the sensed switch may awaken a microprocessor, logic circuit, or other controller used to provide a control signal to a number of switches for selection of one of the multiple current levels. Such switch control and associated current to control switching occurs after the controller wakes upon closure of the sensed switch.

Figure 1:
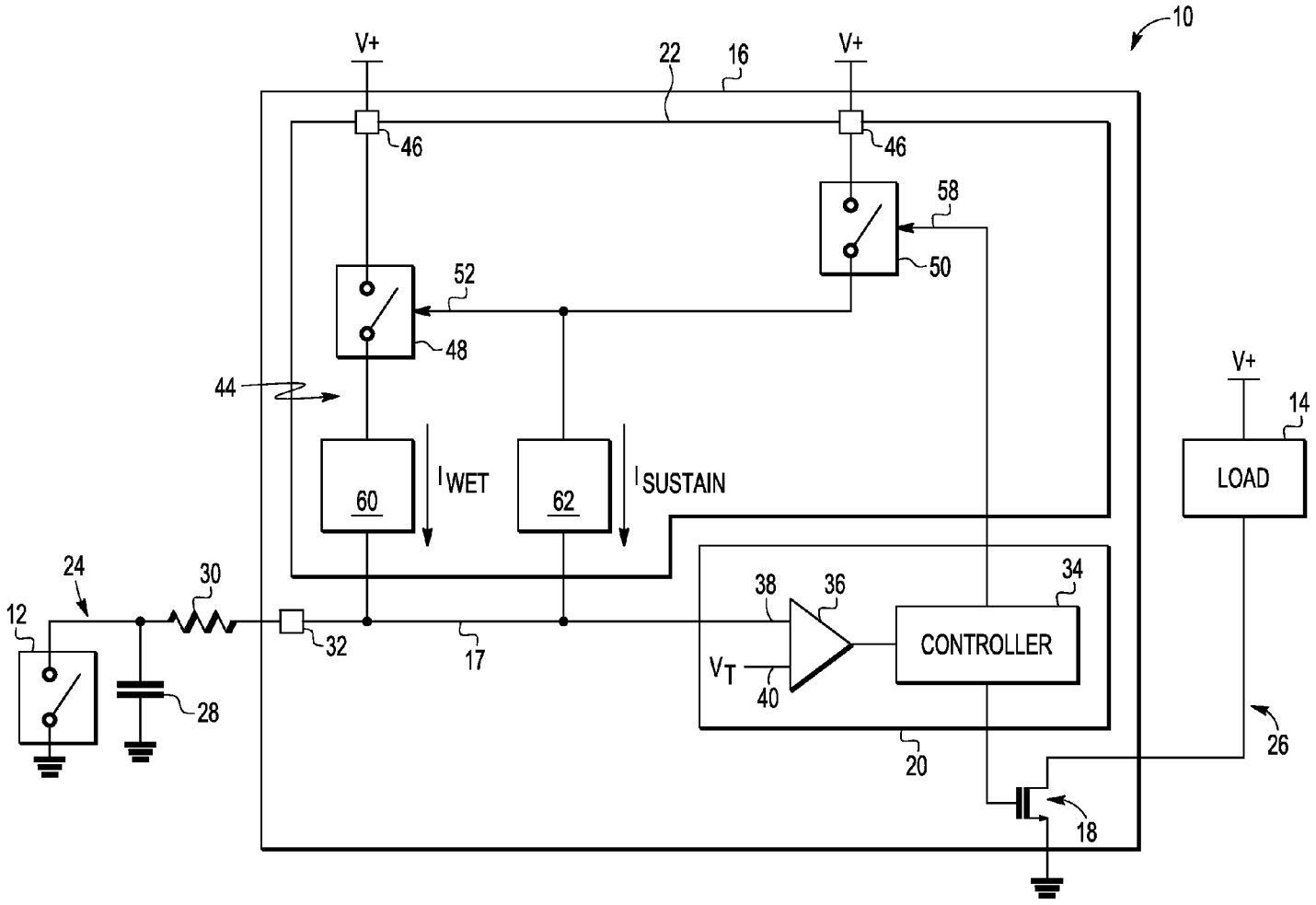
FIG. 1 is a block diagram of an exemplary circuit configured to control current provided to an external sensed switch in accordance with one embodiment.

FIG. 1 depicts an electrical system 10 in which a sensed (or load control) switch 12 is provided to control the operation of a load 14. The load 14 may be a motor, lamp, or any other type of load. The load 14 may be configured for direct current (DC) or alternating current (AC) operation. In this embodiment, the load 14 is powered by a DC power source V+ that also provides power for the sensed switch 12. In other cases, different voltage sources are used. For example, the power source for the load 14 may be a high voltage AC power source, and the power source for the sensed switch 12 may be a low voltage DC power source, which may or may not be derived from or otherwise related to the high voltage AC power source.

In some cases, the electrical system 10 is a vehicular electrical system. The DC power source V+ may be a 12 Volt vehicular battery. In these and other cases, the load 14 is one of a number of loads controlled by respective sensed switches 12. The nature and characteristics of the electrical system 10 may vary considerably.

The state of the sensed switch 12 determines whether power is delivered to the load 14. As a sensed switch, the sensed switch 12 is not disposed in the current path of the power delivered to the load 14. In some cases, the sensed switch 12 is a push-button switch or other normally open sensed switch. For example, in vehicular embodiments, the sensed switch 12 may be a push-button switch, such as a power window push-button switch, directly actuated by an operator or other occupant of the vehicle. The sensed switch 12 may be actuated in a variety of other ways. For example, the sensed switch 12 may be actuated through the opening of a vehicle door or other indirect actuation mechanism.

In the embodiment of FIG. 1, the sensed switch 12 is configured as a switch to ground. As a switch to ground, the closure of the sensed switch 12 establishes a connection to ground. The connection to ground lowers a voltage level, which is sensed to control the delivery of power to the load 14. In other embodiments, the sensed switch 12 is configured as a switch to battery or other voltage source. The sensed switch 12 may be configured to establish a connection to any reference voltage.

A control module or unit 16 senses the connection to ground at an evaluation node 17 of the control unit 16. The sensed switch 12 is coupled to the node 17. During operation, a wetting current Iwet for the sensed switch 12 flows through the node 17. In the switch to ground example of FIG. 1, the connection to ground lowers the voltage level at the node 17. The control unit 16 is configured to detect the lowered voltage level at the node 17 and, thus, the state of the sensed switch 12.

The control unit 16 controls the delivery of power to the load 14 in accordance with the state of the sensed switch 12. The control unit 16 may thus be referred to or configured as a switch detection unit or circuit. In the switch to ground example of FIG. 1, the control unit 16 allows power to reach the load 14 upon detecting the lowered voltage level at the node 17. To this end, the control unit 16 includes a power transistor 18 that acts as a switch to allow current to flow through the load 14. Activation of the power transistor 18 is controlled by the remainder of the control unit 16.

The power transistor 18 is disposed in the current path of the load 14 rather than the sensed switch 12. In this example, the power transistor 18 is a discrete power field effect transistor (FET) device. In other examples, the power FET device is part of an integrated circuit. Other types of transistor devices may be used, such as bipolar junction transistor devices. Other types of switches may be used, including relays.

The control unit 16 may be one of several units in the electrical system 10. Multiple loads 14 may be controlled by each control unit 16. Some of the components of the control unit 16 may be replicated, with a respective instance of the component being provided for each load 14. For example, the control unit 16 may include multiple power transistors 18, one for each load 14.

In the embodiment of FIG. 1, the control unit 16 includes a control circuit 20 and a wetting circuit 22. The control circuit 20 and the wetting circuit 22 may be disposed on respective integrated circuit (IC) chips. In some cases, the control circuit 20 (and/or the wetting circuit 22) includes multiple IC chips. The control circuit 20, the wetting circuit 22, the FET device 18, and any other components of the control unit 16 may be mounted on a common circuit board, and/or disposed in a common housing, and/or otherwise integrated in any other manner or to any other desired extent.

The sensed switch 12 and the load 14 may be external to the board or housing of the control unit 16, or be otherwise disposed remotely from the control unit 16. Wiring 24 may be used to establish a connection between the control unit 16 and the sensed switch 12, and wiring 26 may be used to establish a connection between the control unit 16 and the load 14. For example, a wiring harness may be used to carry the wiring 24, 26 from a door, dashboard, or other panel or portion of a vehicular interior, to another location in the vehicle at which the control unit 16 is located, such as an electronics cabinet under the dashboard. The manner in which the sensed switch 12 and the load 14 are connected to the control unit 16 may vary. For example, components in addition to the wiring harness may be used, including, for instance, fuses.

The length of the wiring 24 may be sufficiently extensive to present significant parasitic capacitance and resistance, which are indicated schematically as an external capacitor 28 and an external resistor 30. In some cases, the capacitor 28 and/or the resistor 30 are additionally or alternatively representative of one or more discrete components disposed in series with the wiring 24. For example, a series resistor may be included for purposes of electrostatic discharge (ESD) protection.

The wiring 24 couples the sensed switch 12 to a pin 32 of the wetting circuit 22. The pin 32 may be one of a set of pins of the IC chip in which the detection circuit is integrated. The packaging of the wetting circuit 22 may vary. The nature of the pin 32 may thus be configured as a post, solder bump, or other connection point of the packaging of the wetting circuit 22. In the embodiment of FIG. 1, the pin 32 corresponds with the node 17. The pin 32 and the node 17 may thus be disposed at the same voltage level. In other cases, the node 17 and the pin 32 may not constitute a common node. For example, a series resistor may be disposed between the node 17 and the pin 32.

The control circuit 20 may be or include a microcontroller or other controller 34 or other logic circuit configured to implement a number of logic functions. The functions may include controlling the power transistor 18. To that end, a control signal may be generated by the controller 34 and provided to a gate or other control terminal of the power transistor 18. The functions may also include analysis of the state of the sensed switch 12. The state of the sensed switch 12 is used to determine whether to generate the control signal. The functions still further include wetting current control or other current selection. The controller 34 implements the control of the wetting current function as described below. Each function may be implemented by a separate logic block, software or firmware module, or other component of the controller 34 and/or the control circuit 20. The logic blocks or other components of the controller 34 directed to implementing these functions may be integrated to any desired extent. For example, a single routine may be implemented by the controller 34 to provide all of the functions. Additional functions may also be provided by the controller 34 and/or the control circuit 20. For example, the control circuit 20 may be configured to provide diagnostic testing for the sensed switch 12.

The wetting current is provided to the sensed switch 12 to burn off the oxidation on the contacts of the sensed switch 12. The term wetting current is used herein to refer to either a current and/or voltage level sufficient to remove the oxidation. The aspects of the wetting current to be controlled include, for instance, the duration of the wetting current. In other cases, the duration and/or other aspects of the wetting current are determined passively (e.g., via a charging or discharging capacitor).

The controller 34 may be or include a general microprocessor or an application-specific microprocessor, such as an application-specific integrated circuit (ASIC). In other embodiments, a field-programmable gate array (FPGA) or other controller may be used as the controller 34. The controller 34 and/or the control circuit 20 may include any combination of firmware and general-purpose memory to store instructions to be executed during operation.

The control circuit 20 and the wetting circuit 22 are responsive to the state of the sensed switch 12. In this example, the control circuit 20 includes a comparator 36. In other cases, the comparator 36 is part of, or integrated with, the wetting circuit 22 or another circuit. The comparator 36 has an input terminal 38 at the node 17 to detect the voltage level at the node 17, which is representative of the state of the sensed switch 12. The comparator 36 accordingly provides an output indicative of the state of the sensed switch 12 based on the voltage level at the input terminal 38 (and the node 17). In this example, the input terminal 38 is one of a pair of input terminals, the other being an input terminal 40 that receives a threshold voltage, VT. Either one of the input terminals 38, 40 may be configured as an inverting input terminal, while the other is configured as a non-inverting input terminal. During operation, the voltage level at the node 17 is compared to the level of the threshold voltage. The control circuit 20 (e.g., the controller 34) is communicatively coupled to an output of the comparator 36. The control circuit 20 receives the output of the comparator 36 to determine whether to activate the power transistor 18 and provide current control signaling (e.g., wetting current control signaling).

The controller 34 may be configured to enter a shutdown or other low power mode while waiting for closure of the sensed switch 12. The controller 34 may be activated or awakened from the low power mode by the output from the comparator 36. For example, the comparator 36 may be configured to provide a logic "1" signal or other high voltage level upon closure of the sensed switch 12. The controller 34 may be configured to awaken when the output of the comparator 36 changes from a logic "0" signal or other low voltage level to the high voltage level.

The configuration of the comparator 36 may vary. For example, the comparator 36 may be or include various types of analog-to-digital converters and/or amplifier circuits, including, for instance, operational amplifier (op-amp) circuits.

The threshold voltage may be provided by threshold circuitry. The threshold circuitry may be coupled to the power source V+ to establish the threshold voltage. In some cases, the threshold circuitry is or includes a voltage divider arrangement. Other types of circuit arrangements may be used. For example, the threshold circuitry may include one or more active devices.

The control circuit 20 and the wetting circuit 22 may be integrated to any desired extent. For example, the comparator 36 may be integrated with the control circuit 20. In some cases, a microcontroller, such as a mixed signal FPGA, may include both an analog-to-digital converter to act as the comparator 36 and one or more logic blocks to implement the logic functionality of the controller 34 and/or other component of the control circuit 20, such as a drive switch 42 (FIG. 2) or other switch or logic.

The wetting circuit 22 includes current control or selection circuitry 44 configured to selectively provide multiple levels of current to the sensed switch 12. The current is provided via the evaluation node 17 upon closure of the sensed switch 12. In some cases, the multiple current levels include a wetting current level (e.g., 15-20 milliamps), and one or more lower current levels (e.g., 1-2 milliamps) sufficient to sustain the closure of the switch. A sustaining, or sealing current or fret current, may be applied after a predetermined time period (e.g., 20 milliseconds) since the closure of the sensed switch 12. Changing from the wetting current to the sustaining current lowers power dissipation, which may be useful in conserving the battery or other power source of the system 10. The number of different current levels may vary. For example, two or more different sustaining current levels may be provided.

The wetting circuit 22 and/or the current control circuitry 44 may be configured to provide other functions in addition to current control. For instance, the current control circuitry 44 may support the detection of the state of the sensed switch 12. The current control circuitry 44 may be configured as or include pull-up circuitry or pull-down circuitry. In the embodiment of FIG. 1, the current control circuitry 44 includes an arrangement of passive circuit elements, some of which provide pull-up functionality. The pull-up (or pull-down) circuitry establishes the voltage level at the node 17. In this example, the pull-up circuitry pulls up the voltage level at the node 17 when the sensed switch 12 is open. The voltage level of the node 17 accordingly does not float when the sensed switch 12 is open. The comparator 36 may thus reliably detect the state of the sensed switch 12.

The current control circuitry 44 is disposed between the evaluation node 17 and a node or pin 46 for the voltage source V+. When the sensed switch 12 is closed, current flows from the voltage source node 46 and through the evaluation node 17 to reach the sensed switch 12. The voltage source node 46 may or may not correspond with a pin or other outward facing node of the wetting circuit 22. The voltage source node 46 is depicted in FIG. 1 as a pair of pins for ease in illustration. Only a single pin may be used to connect the current control circuitry 44 to the voltage source V+. In some cases, the voltage source node 46 may correspond with an internal node of the current control circuitry 44, rather than a pin or other outward-facing node.

The current control circuitry 44 includes control switches 48, 50 disposed between the voltage source node 46 and the evaluation node 17 to switch between multiple current paths for the current flowing through the sensed switch 12. In this example, the control switches 48, 50 switch between a pair of current paths Iwet and Isustain associated with a wetting current level and a sustaining current level, respectively. The wetting current passes through the control switch 48 when flowing along the current path Iwet. The control switch 50 is coupled to a control terminal 52 of the control switch 48 to deactivate the control switch 48 and allow the sustaining current to flow through the current path Isustain.

The control switch 50 is configured to change the voltage level at the control terminal 52 of the control switch 48. In the example of FIG. 1, closure of the control switch 50 applies a high voltage (e.g., the voltage at the voltage source node 46) to the control terminal 52. In other cases, closure of the control switch 50 may pull the voltage at the control terminal 52 to a low voltage (e.g., ground) or another voltage level. In either case, the voltage change deactivates the control switch 48 to switch between the wetting current path and the sustaining current path (and, thus, the corresponding current levels). In other words, the closure of the control switch 50 causes control switch 52 to open.

The control switch 50 is responsive to a control signal generated by the control circuit 20 and/or the controller 34. The control signal may be provided to select (e.g., decrease) the current that flows through the sensed switch 12. For instance, the current may be lowered from the level of the wetting current to the level of the sustaining current. The control signal is generated in response to a change in the output of the comparator 36.

Figure 2:
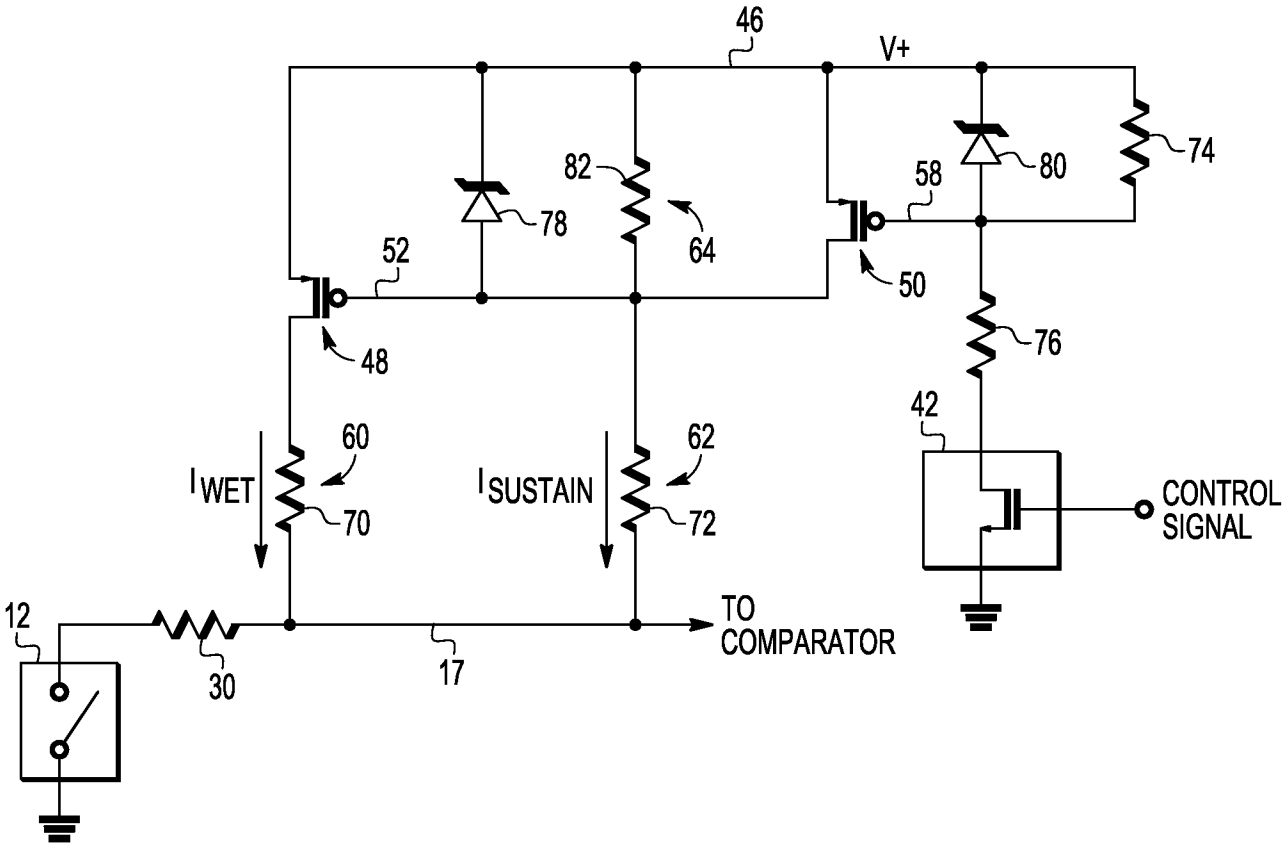
FIG. 2 is a schematic circuit diagram that depicts current control circuitry of the circuit of FIG. 1 in greater detail.

The control signal may be directly applied to the control switch 50 as shown in FIG. 1. Alternatively, the control switch 50 is indirectly responsive to the control signal. In the example of FIG. 2, the control signal is generated by the controller 34 and provided to a control terminal of the drive switch 42. The drive switch 42 may be disposed between the control switch 50 and a reference voltage (e.g., ground). In other cases, the control signal may be provided to a switch or other element of the wetting circuit 22.

The current control circuitry 44 includes an arrangement of passive circuit elements configured to establish the current levels for the respective current paths. In the example of FIG. 1, wetting and sustaining current levels are established for current flow along the current paths Iwet and Isustain, respectively. The arrangement of passive circuit elements is disposed between the voltage source node 46 and the evaluation node 17. Use of the passive circuit elements allows the current control circuitry 44 to be configured such that no current path to ground is present in the arrangement of the passive circuit elements when the sensed switch 12 is open.

In the embodiment of FIG. 1, the circuit arrangement includes passive elements 60, 62, each of which includes a respective resistance. Each resistance may include one or more resistors or other resistive elements. The resistances may be provided as discrete or integrated components. Each passive element 60, 62, 64 may include a single circuit element or a network or set of multiple circuit elements. For example, one or more of the passive elements 60, 62, 64 may include a resistive element and a diode element.

The passive element 60 is disposed along the current path Iwet to establish the wetting current level. The resistance of the passive element 60 may establish the resistance presented by the current path Iwet, thereby setting the wetting current level. The wetting current level may be established by the passive element 60 in combination with one or more other resistive elements, either internal or external to the current control circuitry 44. For example, in some cases, the external resistance 30 may provide sufficient series resistance along the current path Iwet to affect the wetting current level. Current flowing through the current path Iwet from the voltage source node 46 to the sensed switch 12 passes through the control switch 48. The current then passes through the passive element 60 before reaching the evaluation node 17. The passive element 60 may be in series with the conduction path of the control switch 48. In this example, the current path Iwet does not include any active circuit elements between the conduction path of the control switch 48 and the evaluation node 17. The passive element 60 may be the only circuit element between the conduction path of the control switch 48 and the evaluation node 17. In other embodiments, other circuit elements may be present between the control switch 48 and the evaluation node 17.

The passive element 62 is disposed along the current path Isustain to establish the sustaining current level. The resistance of the passive element 62 may establish the resistance presented by the current path Isustain, thereby setting the sustaining current level. The resistance of the passive element 62 may be higher than the resistance of the passive element 60. The higher resistance of the passive element 62 may accordingly lead to a lower current level for the current path Isustain relative to the current level for the current path Iwet. The sustaining current level may be established by the passive element 62 in combination with one or more other resistive elements, either internal or external to the current control circuitry 44. For example, in some cases, the external resistance 30 may provide sufficient series resistance along the current path Isustain to affect the sustaining current level. Alternatively or additionally, a circuit element of the passive element 64 may affect the sustaining current level.

The passive element 62 may support or provide a sensing or trigger function in addition to establishing the sustaining current level. The passive element 62 is disposed between the evaluation node 17 and the control terminal 52 of the control switch 48. The passive element 62 may thus couple the voltage level at the evaluation node 17 to the control terminal 52. With that coupling, the passive element 62 may trigger activation of the control switch 48. The activation allows the current to flow along the current path Iwet. The activation is thus based on the voltage level at the evaluation node 17. For instance, in the example of FIG. 1, upon closure of the sensed switch 12, the voltage level at the evaluation node 17 drops to a level near ground. The passive element 62 may act as a coupling, trigger or sense element to accordingly lower the voltage level at the control terminal 52. If the control switch 48 is activated by a low voltage (e.g., near or below ground, as in a p-channel FET device), then the control switch 48 closes to allow current to flow through the current path Iwet. In other cases, the arrangement of passive circuit elements may be configured to provide a high voltage (e.g., above a positive threshold voltage, as in an n-channel FET device) for activation of the control switch 48.

The current path Isustain does not include any active circuit elements between the control terminal 52 of the control switch 48 and the evaluation node 17. The passive element 62 may be the only circuit element between the control terminal 52 of the control switch 48 and the evaluation node 17. In other embodiments, other circuit elements may be present between the control terminal 52 and the evaluation node 17.

The passive element 64 is disposed between the voltage source node 46 and the control terminal 52 of the control switch 48 to enable the activation and deactivation of the control switch 48. In some cases, the passive element 64 includes a resistive element to ensure that the control switch 48 remains off (or open) while the sensed switch 12 is open. For example, placing a sufficiently large resistive element between the voltage source node 46 and the control terminal 52 may establish that a change in the voltage level at the evaluation node 17 is the only way to activate (or close) the control switch 48. The passive element 64 may accordingly help prevent or reduce leakage current through the control switch 48. Alternatively or additionally, the passive element 64 includes a diode element, such as a zener diode 78, as described in connection with the example of FIG. 2. The diode element may be used to help protect the control switch 48 by clamping or limiting the voltage at the control terminal 52.

During operation, with the sensed switch 12 open, the evaluation node 17 is pulled high (e.g., up toward or near the voltage level at the voltage source node 46) by the passive elements 62 and 64. The voltage level at the control terminal 52 of the control switch 48 is also pulled high (e.g., up toward or near the voltage level at the voltage source node 46). In this example, the control switches 48, 50 are configured to be activated (or closed) by a low voltage (e.g., near or below ground) at the control terminals 52, 58, respectively. As a result, the control switch 48 is off (or open) when the voltage level at the control terminal 52 is pulled high. The control switch 50 is also off (or open) because the output of the comparator 36 is indicative of the open state of the sensed switch 12 and the control signal provided to the control switch 50 is also indicative of the open state. For example, when comparator 36 indicates that the sensed switch 12 is open, controller 34 may apply a high voltage to the control terminal 58 of the control switch 50, turning the control switch 50 off. As a result, the voltage level at the control terminal 52 of the control switch 48 is solely established via the passive element 62.

Once the sensed switch 12 closes, the voltage level at the evaluation node 17 is pulled down (e.g., to or near ground) in this example. As the current flows, the passive elements 62, 64 (and the external resistance 30) form a voltage divider to establish the voltage level at the control terminal 52. The relative resistances of the passive elements 62, 64 are such that the voltage level at the control terminal 52 is pulled sufficiently down to activate (or close) the control switch 48. The current path Iwet to the sensed switch 12 is thus established. At this point, the wetting current flows from the voltage source node 46, and through the control switch 48 and the passive element 60. The resistance presented by the passive element 60 determines the level of the wetting current.

The output of the comparator 36 also changes (e.g., goes high) upon closure of the sensed switch 12. The controller 34 is responsive to the output in multiple ways. First, the controller 34 activates the power transistor 18 to power the load 14 upon closure of the sensed switch 12. After a predetermined time period has elapsed (e.g., 20-30 milliseconds) from closure of the sensed switch 12, the controller 34 also generates the control signal to change the current path in the current control circuitry 44. In some cases, the controller 34 changes the voltage level of the control signal from a low to high voltage level (e.g., from a logic low level at or near ground to a logic high level at or near 5 Volts), but other voltage changes may be used. The control signal activates the control switch 50, which pulls the voltage level of the control terminal 52 of the control switch 48 up to or toward the voltage source V+. The higher voltage level causes current to flow along the current path Isustain through the passive element 62. The higher voltage level also deactivates (or opens) the control switch 48, such that current no longer flows through the passive element 60. The difference in the resistance levels presented by the passive elements 60, 62 thus leads to a change (e.g., decrease) in the current level for the sensed switch 12. For example, the passive element 62 may have a resistance about 5-10 (e.g., 6) times larger than the resistance of the passive element 60, thereby establishing a sustaining current level 5-10 times lower than the wetting current level. Other resistance ratios may be used.

The passive circuit elements of the current control circuitry 44 establish the multiple current levels without being disposed in a current regulating loop or other current source arrangement. As a result, the multiple current levels may be provided without the quiescent current that typically occurs with such arrangements. In contrast, the network of passive (e.g., resistive) circuit elements and other components of the current control circuitry 44 may provide the multiple current levels without any quiescent current.

Various aspects of the control unit 16 or the wetting circuit 22 may be replicated to support multiple sensed switches 12. Each wetting circuit 22 may be configured to handle multiple sensed switches 12. Each wetting circuit 22 may thus have multiple comparators 36. Respective current control circuitry 44 may be provided for each sensed switch 12. Alternatively or additionally, each control unit 16 includes multiple detection circuits 22. A single microprocessor or other control circuit 20 may be coupled to the multiple comparators 36 and/or multiple detection circuits 22. The control circuit 20 may thus be configured to handle the detection and testing of multiple wetting current paths and/or multiple detection circuits 22. Alternatively, one or more aspects of the control circuit 20 are separately provided for each wetting circuit 22 and/or for each sensed switch 12.

The mechanism for transition between the states of the sensed switch 12 may vary. For example, the sensed switch 12 may be a momentary push button switch or a toggle push button switch. Any type of switch may be used for the sensed switch 12, including non-push-button switches.

FIG. 2 depicts the current control circuitry 44 of the wetting circuit 22 in greater detail. In this example, each of the control switches 48, 50 is or includes a p-channel field effect transistor (FET) device. The p-channel FET devices may be configured for activation when the voltage on the respective control terminal 52, 58 is near, at, or below ground. The control terminals 52, 58 correspond with respective gate terminals of the FET devices. The source and drain terminals of the FET devices 48, 50 are connected along the current paths Iwet and Isustain, respectively. In this example, a source terminal of each FET device 48, 50 is connected to the voltage source node 46. In other cases, one or more passive elements may be disposed between the FET device 48 or 50 and the voltage source node 46. The drain terminal of the FET device 48 is connected in series with the passive element 60. The drain terminal of the FET device 50 is connected to the gate terminal of the FET device 48. During operation, the wetting current flows through the source and drain terminals of the FET device 48, and the sustaining current flows through the source and drain terminals of the FET device 50.

In some cases, other types of transistor devices or switches may be used in or as the control switches 48, 50. For example, one or both of the control switches 48, 50 may be configured as bipolar junction transistor (BJT) devices or relays. In BJT examples, the base terminals of the BJT devices may be connected to receive a control current level for activation and deactivation. Additional and/or alternative connections to the BJT devices may be used. The connections may include one or more resistances to limit the base current to appropriate levels.

In the embodiment of FIG. 2, the passive element 60 along the current path Iwet is or includes a single resistor 70, although multiple resistors may be used in an alternate embodiment. The passive element 62 along the current path Isustain is or includes a single resistor 72, although multiple resistors may be used in an alternate embodiment. In one example with a voltage source V+ of about 12 Volts (e.g., a vehicle battery), the resistors 70, 72 may have resistances of about 1 kilohm and about 6 kilohms, respectively. The wetting and sustaining currents may thus differ by a factor of 6. A wide variety of resistance levels, current levels, and differences therein may be used. The resistors 70, 72 may be configured as discrete and/or integrated components. For example, the resistor 70 may be formed in the same substrate as the FET device 48.

Resistors 74 and 76 are connected to the gate terminal 58 of the control switch 50. The resistor 74 is disposed between the voltage source node 46 and the gate terminal 58 of the FET device 50. The resistor 76 is disposed between the gate terminal 58 and the drive switch 42. In the example of FIG. 2, activation (or closing) of the drive switch 42 pulls the gate terminal 58 to ground via the resistor 76. Conversely, when the drive switch 42 is not activated (or is open), the resistor 74 acts as a passive pull-up for the FET device 50. The resistor 74 pulls the voltage at the gate terminal 58 up toward the voltage level of the voltage source node 46 unless the drive switch 42 is activated. The resistor 74 thus ensures that the control switch 50 remains deactivated until otherwise directed by the control signal and the drive switch 42.

In the embodiment of FIG. 2, the passive element 64 includes a zener diode 78 connected to the gate terminal 52 of the FET device 48. The zener diode 78 may be connected in parallel with the resistor 74 between the voltage source node 46 and the gate terminal 52 of the FET device 48. The zener diode 78 protects the FET device 48 by limiting the voltage applied to the control terminal 52. A zener diode 80 may be connected to the gate terminal 58 of the FET device 50 for the same reason. The zener diodes 78, 80 may not be included in other embodiments, such as those having lower voltage source levels and/or FET devices with wider tolerances.

The passive element 64 also includes a resistor 82. The resistor 82 is connected in parallel with the zener diode 78 between the voltage source node 46 and the gate terminal 52 of the FET device 48. In the example of FIG. 2, the resistor 82 acts as a passive pull-up, ensuring that the FET device 48 remains deactivated unless the sensed switch 12 is closed.

The resistor 82 may have a large resistance relative to the other resistors in the current control circuitry 44. The large resistance may also establish an appropriate voltage level for the gate terminal 52 when the sensed switch 12 is closed. With current flowing through the evaluation node 17 upon closure of the sensed switch 12, the resistors 72, 82 form a voltage divider. The voltage level at the gate terminal 52 is then brought low (e.g., near ground) if the resistance presented by the resistor 72 is much lower than the resistance of the resistor 82. In some examples, the resistor 82 may have a resistance of about 10 megaOhms. A wide range of other resistances may be used.

As shown in FIG. 2, the circuit arrangement of the current control circuitry 44 does not present a current path to ground when the sensed switch 12 is open. The resistors 70 and 72 are disposed along the current paths Iwet and Isustain, respectively, without any active elements between the FET devices 48, 50, and the evaluation node 17. The resistors 70 and 72 are thus used to establish the wetting and sustaining current levels without having to resort to current regulating loops or other current source arrangements in which a path to ground is present throughout operation. The circuit arrangement may vary from the example of FIG. 2 and still avoid a quiescent current path to ground. For example, the current control circuitry 44 may have a differently configured level shifter, such as one in which the control signal is provided directly, rather than indirectly, to the level shifter. The components of the level shifter may also differ in examples in which a BJT device is used for the control switch 48.

Figure 3:
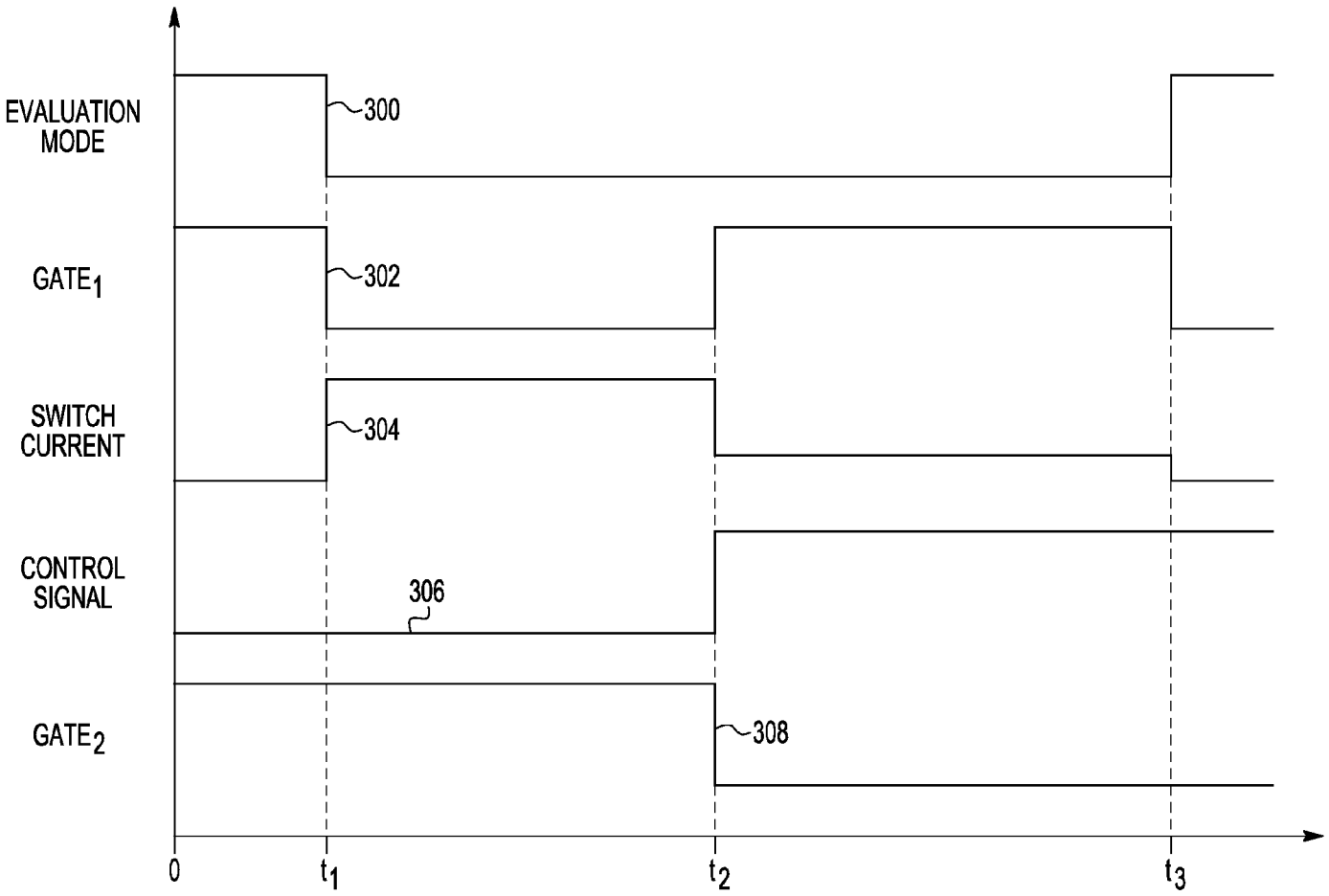
FIG. 3 is a timing diagram to show a number of signal levels during operation of the circuit of FIG. 1 in accordance with one embodiment.

FIG. 3 shows a set of signal waveforms to depict the operation of the current control circuitry 44. A waveform 300 depicts the voltage at the evaluation node. At time t1, the sensed switch is closed, and the voltage drops from a high level (e.g., near the voltage source level) to a low level (e.g., near ground). At that point, the voltage at the gate terminal of the control switch 48 (FIGS. 1 and 2) also drops from a high level (e.g., near the voltage source level) to a low level (e.g., near ground), as shown in waveform 302. The current flowing through the evaluation node and the sensed switch accordingly rises to the wetting current level, as shown in waveform 304.

After a predetermined time from time t1 (e.g., 20 milliseconds or some other time period), the controller 34 (FIG. 1) generates a control signal to lower the current to the sustaining current level. The control signal may be provided as a logic signal waveform 306 that rises from a low level (e.g., at or near ground) to a higher level (e.g., at or near 5 Volts). The change occurs at time t2 in this example. In response to the control signal, the voltage level at the gate terminal of the control switch 50 (FIGS. 1 and 2) drops from a high level (e.g., near the voltage source level) to a low level (e.g., near ground), as shown in waveform 308. The control switch 50 is activated, thereby returning the voltage level at the gate terminal of the other control switch 48 to the higher level, as shown in waveform 302. The control switch 48 is deactivated, changing the current path to the sensed switch. As a result, the current level drops to the sustaining current level as shown in waveform 304. The sustaining current is provided until the sensed switch closes and the voltage level at the evaluation node is accordingly pulled back up to the high level at time t3 as shown in waveform 300.

Figure 4:
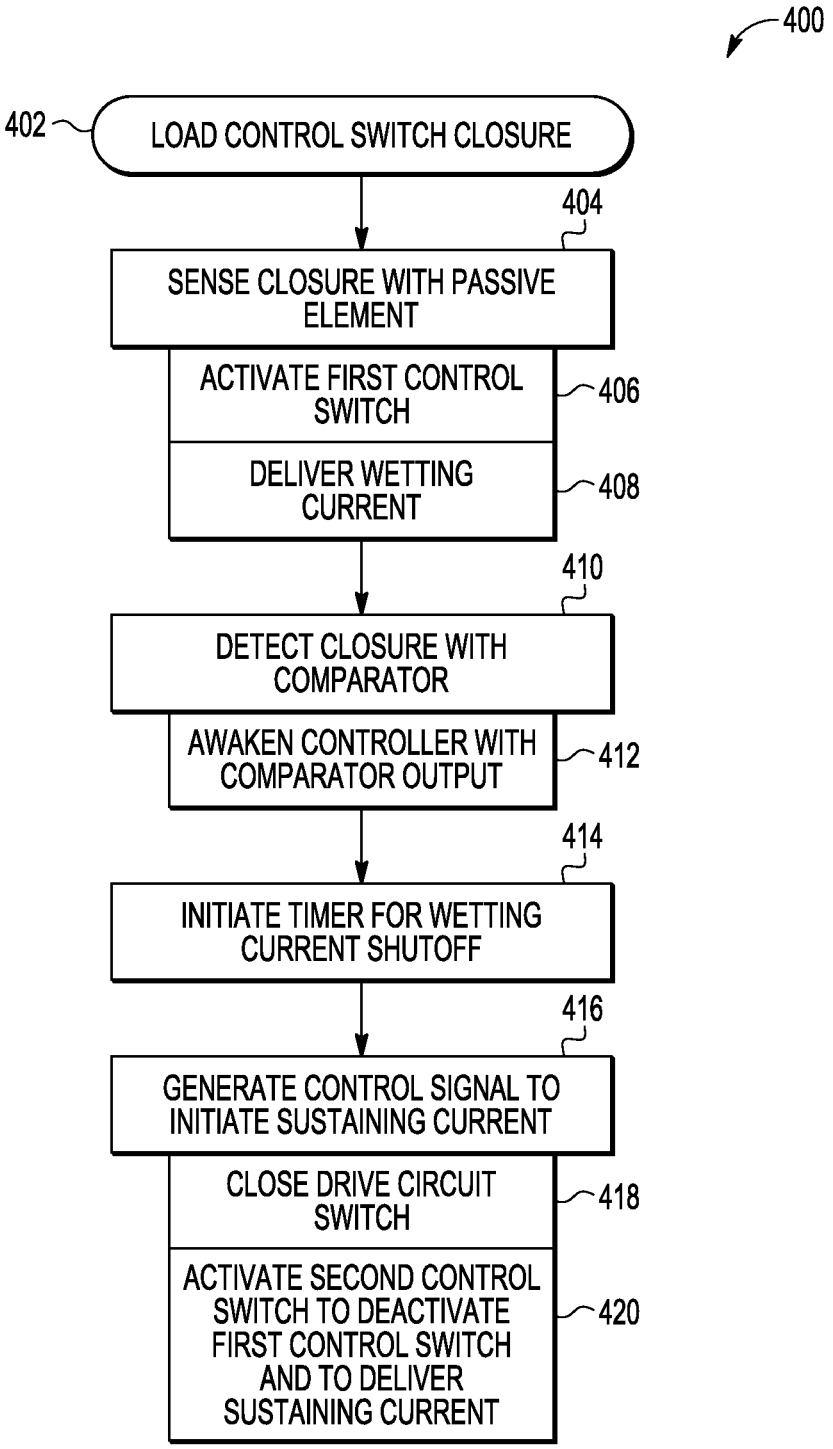
FIG. 4 is a process flow diagram of an exemplary method of wetting current control in accordance with one embodiment.

FIG. 4 shows an exemplary method 400 for current control or selection. The method may be implemented by the control circuits or controllers described above. In some cases, another processor or controller may be used to implement the method either in conjunction with the above-described controllers or separately therefrom. The method 400 includes a sequence of acts or steps, only the salient of which are depicted for convenience in illustration. Additional, fewer, or alternative acts may be included. For example, the method 400 may include providing currents at additional current levels. The ordering of the acts may vary in other embodiments. For example, the order in which the different current levels is provided may vary.

The method 400 is described in connection with a switch to ground sensed switch arrangement (e.g., the arrangement of FIGS. 1 and 2 in which the sensed switch 12 is coupled to ground). The method 400 may alternatively be applied in connection with a switch to battery arrangement (e.g., an embodiment in which a sensed switch is coupled to a positive voltage reference).

The method 400 may be applied to selectively control the application of wetting current to a normally open sensed switch (also referred to as a "load control switch"). With the sensed switch normally open, oxidation of the switch contacts may occur over time. The contacts of the sensed switch may thus benefit from the application of the wetting current each time that the sensed switch is closed. The method is directed to selecting between the wetting current and one or more other (e.g., reduced) current levels. Unlike other current source techniques for selectively providing the wetting current, the current control or selection may be provided without current drain when the sensed switch is open.

The method 400 may begin with, or include, act 402 in which the sensed switch is closed. The closure is sensed in act 404 with a passive element connected to an evaluation node for the sensed switch. The passive element may include a resistor or resistance as described above. The sensing of the closure activates a control switch in act 406 to deliver current (e.g., wetting current) in act 408 through the sensed switch and along a current path in which the control switch is disposed (e.g., the wetting current path). The current is delivered at a level established by another passive element disposed along the current path in series with the control switch.

The closure of the sensed switch is also (e.g., simultaneously) detected in act 410 with a comparator. The comparator is connected to the evaluation node to detect the closure as described above. The detection of the closure causes the output of the comparator to change. The change in the output may awaken or activate a controller or control circuit in act 412. Once awakened or otherwise active, the controller may initiate a timer in act 414 determinative of the time period during which the current is provided at the first level (e.g., wetting current level). The timer may be digitally implemented or implemented via analog circuitry (e.g., with a capacitor). The timer may be used to determine when to switch the current to a second current path. The control signal determination may be based on alternative or additional factors. For instance, a variety of non-time-based factors may be used, such as factors relating to the condition of the power source.

In the embodiment of FIG. 4, expiration of the timer causes the controller to generate a control signal in act 416 to change the level of current provided to the sensed switch. For example, the control signal may lead to discontinuing the wetting current and initiating a sustaining current. In some cases, the control signal is provided to close (or turn off) a drive switch in act 418.

The control signal causes a second control switch to be activated in act 420, thereby causing the first control switch to be deactivated as described above. The deactivation and activation of the first and second switches causes the current path to change a second current path (e.g., the sustaining current path) as described above. A second passive circuit element is disposed along the second current path to establish a second (e.g., lower) current level for the current. In some cases, the second passive circuit element corresponds with the passive element used to sense the closure of the sensed switch (e.g., in act 404).

The above-described devices and methods provide a temporary wetting current (or other current level) without an active circuit to select and/or initiate the current level. The wetting current is provided without wasting power in the active circuit while waiting for closure of the sensed switch.

In a first aspect, a circuit for a sensed switch includes an evaluation node through which current flows from a voltage source node to the sensed switch when the sensed switch is closed, and first and second control switches disposed between the voltage source node and the evaluation node to switch between first and second current paths for the current. The current passes through the first control switch when flowing along the first current path. The second control switch is coupled to a control terminal of the first control switch to deactivate the first control switch and allow the current to flow through the second current path. The circuit further includes a plurality of passive circuit elements configured to establish first and second current levels for the current when flowing along the first and second current paths, respectively, and disposed between the voltage source node and the evaluation node in a circuit arrangement in which no current path to ground is present when the sensed switch is open.

In a second aspect, a circuit for a sensed switch includes a comparator configured to detect a state of the sensed switch and having an input terminal at an evaluation node having a voltage level representative of the state of the sensed switch and through which wetting and sustaining currents flow from a voltage source node to the sensed switch when the sensed switch is closed. The circuit further includes first and second control switches disposed between the voltage source node and the evaluation node to switch between first and second current paths for the current. The wetting current passes through the first control switch when flowing along the first current path. The second control switch is coupled to a control terminal of the first control switch to deactivate the first control switch and allow the sustaining current to flow through the second current path. The circuit further includes a first resistance disposed along the first current path to establish a first current level for the wetting current when flowing along the first current path, and a second resistance disposed along the second current path and configured to establish a second current level for the sustaining current when flowing along the second current path. The second element is disposed between the evaluation node and the control terminal of the first control switch to trigger activation of the first control switch to allow the wetting current to flow along the first current path based on the voltage level of the evaluation node.

In a third aspect, a method of providing wetting current for a sensed switch includes sensing closure of the sensed switch to activate a first control switch to deliver current through the sensed switch and along a first current path at a first current level, activating a controller in response to an output of the comparator indicative of the closure of the sensed switch, and generating, with the controller, a control signal to switch the current to a second current path. Generating the control signal includes activating a second control switch to deactivate the first control switch. A plurality of passive circuit elements are configured to establish the first and second current levels and disposed between a voltage source node and an evaluation node at which a comparator detects the closure of the sensed switch in a circuit arrangement in which no current path to ground is present when the sensed switch is open.

Although described in connection with sensed switches for use in vehicles, the disclosed embodiments are not limited to any particular type or application of sensed switches. The sensed switches may be used to control any type of load. The sensed switches are thus not limited to motors (or DC motors), lamps, or other types of loads commonly present on vehicles. The sensed switches are thus also not limited to uses involving 12-Volt batteries or other batteries.

The disclosed embodiments are also compatible with a variety of different sensed switch environments. The wetting current diagnostics may be provided regardless of the external resistance and/or capacitance presented by the wiring harness and/or other components or aspects of the system in which the sensed switch is disposed. The disclosed embodiments may utilize a voltage threshold established for the comparator of the detection unit to avoid any requirements for customization to a specific switch environment.

Although described in connection with single-pole, single-throw switches, the disclosed embodiments are not limited to any particular type of switch. The number of poles may vary. The number of connection options may also vary. For example, the disclosed embodiments may be configured for use with double-throw or triple-throw switches.

While the wetting current diagnostics are useful for normally open switches, the disclosed embodiments may be used in connection with normally closed switches and/or other types of switches. The extent to which wetting current is useful for the sensed switch may vary.

The present invention is defined by the following claims and their equivalents, and nothing in this section should be taken as a limitation on those claims. Further aspects and advantages of the invention are discussed above in conjunction with the preferred embodiments and may be later claimed independently or in combination.

While the invention has been described above by reference to various embodiments, it should be understood that many changes and modifications may be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A circuit for a sensed switch, the circuit comprising:

an evaluation node through which current flows from a voltage source node to the sensed switch when the sensed switch is closed;

first and second control switches disposed between the voltage source node and the evaluation node to switch between first and second current paths for the current, wherein the current passes through the first control switch when flowing along the first current path, and wherein the second control switch is coupled to a control terminal of the first control switch such that the second control switch is configured to change a voltage level at the control terminal to deactivate the first control switch and allow the current to flow through the second current path; and a plurality of passive circuit elements configured to establish first and second current levels for the current when flowing along the first and second current paths, respectively, and disposed between the voltage source node and the evaluation node in a circuit arrangement in which no current path to ground is present when the sensed switch is open.

2. The circuit of claim 1, wherein the plurality of passive circuit elements comprises:

a first resistance disposed along the first current path to establish the first current level; and a second resistance disposed along the second current path to establish the second current level.

3. The circuit of claim 2, wherein the second resistance is disposed between the evaluation node and the control terminal of the first control switch to trigger activation of the first control switch to allow the current to flow along the first current path based on a voltage level at the evaluation node.

4. The circuit of claim 1, wherein the first current path does not include any active circuit elements between the first control switch and the evaluation node.

5. The circuit of claim 1, wherein the first and second current levels are wetting and sustaining current levels, respectively.

6. The circuit of claim 1, further comprising a comparator having an input terminal at the evaluation node to detect the state of the sensed switch based on the voltage level of the evaluation node.

7. The circuit of claim 6, further comprising a logic circuit coupled to the comparator, configured to be activated by a change in an output of the comparator, and comprising a drive switch disposed between the second control switch and a reference voltage, wherein the change in the output closes the drive switch.

8. The circuit of claim 1, wherein the plurality of passive circuit elements are not disposed in a current regulating loop arrangement.

9. The circuit of claim 1, wherein each of the first and second control switches comprises a respective p-channel field effect transistor (FET) device.

10. A circuit for a sensed switch, the circuit comprising:

an evaluation node through which current flows from a voltage source node to the sensed switch when the sensed switch is closed;

first and second control switches disposed between the voltage source node and the evaluation node to switch between first and second current paths for the current, wherein the current passes through the first control switch when flowing along the first current path, and wherein the second control switch is coupled to a control terminal of the first control switch to deactivate the first control switch and allow the current to flow through the second current path; and a plurality of passive circuit elements configured to establish first and second current levels for the current when flowing along the first and second current paths, respectively, and disposed between the voltage source node and the evaluation node in a circuit arrangement in which no current path to ground is present when the sensed switch is open;

wherein the second current path does not include any active circuit elements between the control terminal of the first control switch and the evaluation node.

11. A circuit for a sensed switch, the circuit comprising:

an evaluation node through which current flows from a voltage source node to the sensed switch when the sensed switch is closed;

first and second control switches disposed between the voltage source node and the evaluation node to switch between first and second current paths for the current, wherein the current passes through the first control switch when flowing along the first current path, and wherein the second control switch is coupled to a control terminal of the first control switch to deactivate the first control switch and allow the current to flow through the second current path;

a plurality of passive circuit elements configured to establish first and second current levels for the current when flowing along the first and second current paths, respectively, and disposed between the voltage source node and the evaluation node in a circuit arrangement in which no current path to ground is present when the sensed switch is open;

a comparator having an input terminal at the evaluation node to detect the state of the sensed switch based on the voltage level of the evaluation node; and a logic circuit coupled to the comparator, the logic circuit being configured to generate a control signal to activate the second control switch after a predetermined time period has elapsed.

12. A circuit for a sensed switch, the circuit comprising:

an evaluation node through which current flows from a voltage source node to the sensed switch when the sensed switch is closed;

first and second control switches disposed between the voltage source node and the evaluation node to switch between first and second current paths for the current, wherein the current passes through the first control switch when flowing along the first current path, and wherein the second control switch is coupled to a control terminal of the first control switch to deactivate the first control switch and allow the current to flow through the second current path; and a plurality of passive circuit elements configured to establish first and second current levels for the current when flowing along the first and second current paths, respectively, and disposed between the voltage source node and the evaluation node in a circuit arrangement in which no current path to ground is present when the sensed switch is open;

wherein the plurality of passive circuit elements further comprise a resistance disposed between the voltage source node and the control terminal of the first control switch to ensure the first control switch is deactivated while the sensed switch is open.

13. A circuit for a sensed switch, the circuit comprising:

a comparator configured to detect a state of the sensed switch and having an input terminal at an evaluation node having a voltage level representative of the state of the sensed switch and through which wetting and sustaining currents flow from a voltage source node to the sensed switch when the sensed switch is closed;

first and second control switches disposed between the voltage source node and the evaluation node to switch between first and second current paths for the current, wherein the wetting current passes through the first control switch when flowing along the first current path, and wherein the second control switch is coupled to a control terminal of the first control switch to deactivate the first control switch and allow the sustaining current to flow through the second current path;

a first resistance disposed along the first current path to establish a first current level for the wetting current when flowing along the first current path; and a second resistance disposed along the second current path and configured to establish a second current level for the sustaining current when flowing along the second current path, wherein the second resistance is disposed between the evaluation node and the control terminal of the first control switch such that the second resistance couples the voltage level of the evaluation node to the control terminal to trigger activation of the first control switch to allow the wetting current to flow along the first current path based on the voltage level of the evaluation node.

14. The circuit of claim 13, wherein the first and second resistances are disposed in a circuit arrangement in which no current path to ground is present when the sensed switch is open.

15. The circuit of claim 13, wherein:

the first current path does not include any active circuit elements between the first control switch and the evaluation node; and the second current path does not include any active circuit elements between the control terminal of the first control switch and the evaluation node.

16. The circuit of claim 13, further comprising a logic circuit coupled to the comparator, configured to be activated by a change in an output of the comparator, and comprising a drive switch disposed between the second control switch and a reference voltage, wherein the change in the output closes the drive switch.

17. A method of providing wetting current for a sensed switch, the method comprising:

sensing closure of the sensed switch to activate a first control switch to deliver current through the sensed switch and along a first current path at a first current level;

activating a controller in response to an output of the comparator indicative of the closure of the sensed switch; and generating, with the controller, a control signal to switch the current to a second current path, wherein generating the control signal comprises activating a second control switch such that the second control switch deactivates the first control switch;

wherein a plurality of passive circuit elements are configured to establish the first and second current levels, and wherein the plurality of passive circuit elements are disposed between a voltage source node and an evaluation node at which a comparator detects the closure of the sensed switch in a circuit arrangement in which no current path to ground is present when the sensed switch is open.

18. The method of claim 17, wherein the plurality of passive circuit elements comprise:

a first resistance disposed along the first current path to establish the first current level; and a second resistance disposed along the second current path to establish the second current level.

19. A method of providing wetting current for a sensed switch, the method comprising:

sensing closure of the sensed switch to activate a first control switch to deliver current through the sensed switch and along a first current path at a first current level;

activating a controller in response to an output of the comparator indicative of the closure of the sensed switch; and generating, with the controller, a control signal to switch the current to a second current path, wherein generating the control signal comprises activating a second control switch to deactivate the first control switch;

wherein a plurality of passive circuit elements are configured to establish the first and second current levels, and wherein the plurality of passive circuit elements are disposed between a voltage source node and an evaluation node at which a comparator detects the closure of the sensed switch in a circuit arrangement in which no current path to ground is present when the sensed switch is open, wherein the plurality of passive circuit elements comprise:

a first resistance disposed along the first current path to establish the first current level; and a second resistance disposed along the second current path to establish the second current level, and wherein sensing the closure comprises sensing a voltage level at the evaluation node with the second resistance.

20. A method of providing wetting current for a sensed switch, the method comprising:

sensing closure of the sensed switch to activate a first control switch to deliver current through the sensed switch and along a first current path at a first current level;

activating a controller in response to an output of the comparator indicative of the closure of the sensed switch;

generating, with the controller, a control signal to switch the current to a second current path, wherein generating the control signal comprises activating a second control switch to deactivate the first control switch; and upon activating the controller, initiating a timer to determine when to generate the control signal to switch the current to the second current path.

* * * * *